US005702332A

United States Patent [19]

Hsieh

[11] Patent Number: 5,702,332

[45] Date of Patent: Dec. 30, 1997

[54] DUAL EXERCISE APPARATUS WITH RESISTANCE ADJUSTMENT AND INTERCONNECTION ARRANGEMENT FOR USER MOVABLE ELEMENTS

[75] Inventor: Yi Fong Hsieh, Succasunna, N.J.

[73] Assignee: LifeGear, Inc., Rockaway Township, N.J.

[21] Appl. No.: 621,293

[22] Filed: Mar. 22, 1996

[51] Int. Cl.[6] ..... A63B 21/04

[52] U.S. Cl. ..... 482/130; 482/137; 482/138; 482/133

[58] Field of Search ..... 422/123, 129, 422/130, 133, 134, 135, 136, 137, 138

[56] References Cited

U.S. PATENT DOCUMENTS 4,600,196 7/1986 Jones ..... 482/130

5,498,222 3/1996 Hur ..... 482/130

5,518,482 5/1996 Hsieh ..... 482/130

*Primary Examiner*—Lynne A. Reichard

*Attorney, Agent, or Firm*—David L. Davis

[57] ABSTRACT

An exercise apparatus having movable elements which are manipulatable against resistance by a user to selectively exercise either the abdominal muscles or the back muscles of the user. The movable elements are interconnected for concurrent movement. Resistance to their movement is provided by an elastic resistance band which is secured to one of the elements and to a fixed support structure of the exercise apparatus. An adjustment mechanism is provided for pre-tensioning the resistance band.

9 Claims, 3 Drawing Sheets

DUAL EXERCISE APPARATUS WITH RESISTANCE ADJUSTMENT AND INTERCONNECTION ARRANGEMENT FOR USER MOVABLE ELEMENTS

BACKGROUND OF THE INVENTION

This invention relates to exercise apparatus and, more particularly, to such apparatus which includes a pair of movable elements each adapted for user manipulation in a respective direction during a respective one of a pair of independent exercises. Specifically, the invention relates to the interconnection of the pair of movable elements and to the provision of an arrangement for fine tuning the resistance applied to the pair of movable elements.

In recent years, people have become more interested in physical fitness. However, regular attendance at a gym or health club can be expensive and/or inconvenient to many people. Accordingly, there is a need for exercise apparatus which can be utilized in the home. For reasons of economy, such apparatus should be relatively inexpensive, while at the same time affording the user the opportunity to perform more than one type of exercise on such apparatus.

One such type of home exercise apparatus allows a seated user to lean forward and manipulate a first movable element against resistance to exercise the user's abdominal muscles and, alternatively, to lean back and manipulate a second movable element against resistance to exercise the user's back muscles. In such apparatus, the resistance is typically provided by one or more elastic resistance bands secured to fixed structure of the apparatus and to a selected one of the movable elements manipulated by the user during the selected exercise. It is an object of the present invention to provide an arrangement by which a single elastic resistance band can be mounted to provide resistance for both of the exercises.

Elastic resistance bands are typically available in different sizes to provide different discrete amounts of resistance. The user selects a resistance band for installation on the exercise apparatus based upon the desired level of resistance. It is often desirable for the user to be able to select a resistance which is between the discrete resistances provided by the bands. It is therefore another object of this invention to provide an arrangement by means of which the user can vary the resistance provided by a particular resistance band.

SUMMARY OF THE INVENTION

This invention is useful in conjunction with exercise apparatus of the type having a fixed support, a pair of movable elements each adapted for user manipulation in a respective direction during a respective one of a pair of independent exercises, and an elastic resistance element. The foregoing and additional objects of this invention are attained by providing an arrangement for coupling together the fixed support, the pair of movable elements and the resistance element. The inventive arrangement comprises a pair of intermeshed circular gears mounted to the fixed support for rotation in opposite angular directions each about a respective one of a pair of parallel axes, means for securing a first of the movable elements to a first of the gears for rotation therewith, and means for securing the second of the movable elements to the second of the gears for rotation therewith. First holding means is provided which is secured to one of the movable elements for holding a first end of the resistance element and second holding means is also provided which is secured to the fixed support for holding the second end of the resistance element. Accordingly, when doing an exercise by moving one of the elements, the other element is also moved and the resistance is transmitted through the gears.

In accordance with an aspect of this invention, one of the first and second holding means includes means for selectively varying the position of the respective end of the resistance element relative to the respective one of the movable elements and the fixed support. Accordingly, the amount of resistance provided by the resistance element is adjustable by providing a selected bias (pre-tension) to the elastic resistance element.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
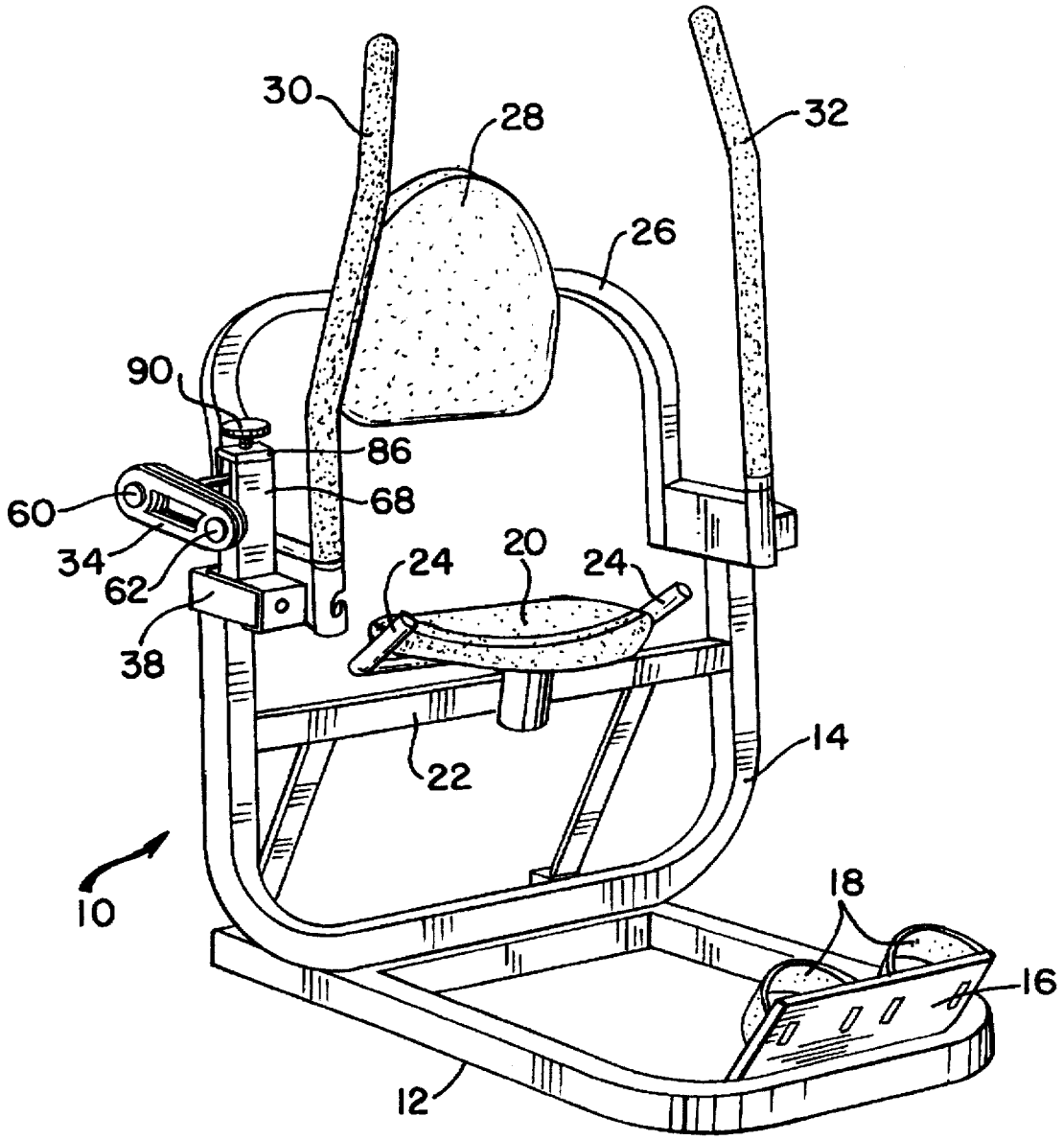
FIG. 1 is a perspective view of illustrative exercise apparatus incorporating mechanism constructed in accordance with the principles of this invention.

Referring now to the drawings, the exercise apparatus 10 shown in FIG. 1 is an illustrative environment in which the present invention finds utility. The apparatus 10 is designed to allow a user to perform two separate and independent exercises. A first of the exercises works the abdominal muscles of the user and the second of the exercises works the back muscles of the user. As shown, the apparatus 10 includes fixed structure including a floor supported base frame 12 and a user support frame 14. A foot plate 16 with foot straps 18 is mounted to the base frame 12 and a seat 20 is mounted to the cross member 22 of the support frame 14. Preferably, the seat 20 is pivotable about a vertical axis and a pair of hand grips 24 are secured to the underside of the seat 20.

Mounted to the user support frame 14, in a manner to be described hereinafter, are movable elements adapted for user manipulation against resistance to provide the desired muscular workouts. Thus, a back frame 26 having a back pad 28 secured thereto is provided for performing back exercises. A pair of handle bars 30, 32 are provided for performing abdominal exercises. It is noted at this point that when performing the back exercises, the back frame 26 moves away from the handle bars 30, 32 and when performing the abdominal exercises the handle bars 30, 32 move away from the back frame 26. Each of these exercises is independent of the other and the user directly applies force to only one of the back frame 26 or the pair of handle bars 30, 32. Resistance for the desired exercise is provided by the elastic resistance band 34 which is secured at one end to the support frame 14 and at the other end to the back frame 26, as will be described in full detail hereinafter.

Figure 2:
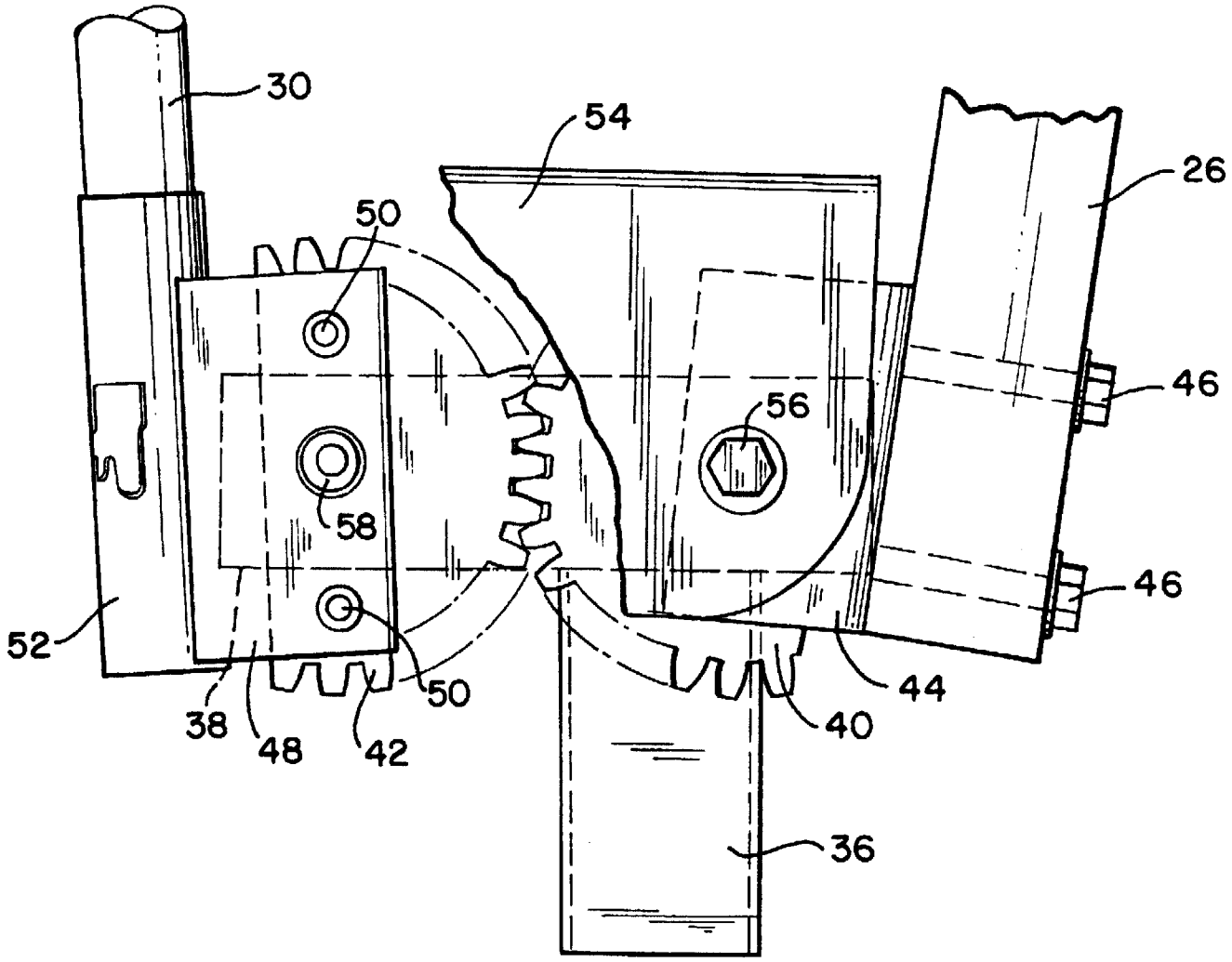
FIG. 2 is a partially cut away side view showing an inventive mechanism for mounting and interconnecting the movable elements.

The applicant has recognized that by interconnecting the back frame 26 with the handle bars 30, 32 for concurrent pivoting movement in opposite angular directions, a single resistance band 34 connected between the fixed support structure and one of the movable elements can be utilized to provide resistance to whichever of the movable elements is being used for performing a desired exercise. FIG. 2 is a partially cut away side view, looking from the seat 20, of structure for mounting and interconnecting the back frame 26 and the handle bar 30. The corresponding structure for mounting and interconnecting the back frame 26 and the handle bar 32 is the mirror image of the structure shown in FIG. 2. As shown, the mounting and interconnecting structure includes a vertically oriented base tube 36 which is adapted for insertion into the hollow tubular support frame 14 and is secured thereto by means of screws or the like (not shown). A horizontal support bar 38 is secured to the top of the base tube 36, as by welding. First and second circular gear segments 40, 42 are provided for mounting and interconnecting the back frame 26 and the handle bar 30, respectively. The gear segment 40 is straddled by a U-shaped bracket 44 and is secured to the gear segment 40 by bolts (not shown) and an axle (not shown) is secured to the cross bar 38 and extends through suitable openings in the bracket 44 and the gear segment 40 to mount the gear segment 40 for rotation about a first horizontal axis. The back frame 26 is secured to the bracket 44 by bolts 46 which extend through the back frame 26 and are threadedly engaged in suitable apertures in the closed end of the bracket 44.

The circular gear segment 42 is straddled by the U-shaped bracket 48. The bracket 48 is secured to the gear segment 42 by the bolts 50 and is rotatably mounted, along with the gear segment 42, to the support bar 38 in a similar manner as the bracket 44 and the gear segment 40 for rotation about a second horizontal axis. The closed end of the bracket 48 is curved inwardly and the hollow tube 52 engages the curved end and is secured thereto as by welding. The handle bar 30 is then inserted into the tube 52. A cover member 54 is secured to the aforedescribed assembly by short bolts 56 which are threaded into apertures in raised bosses 58 on the brackets 44, 48.

To provide resistance for the exercises performable using the apparatus 10, an elastic resistance band 34 is held at one end by the post 60 secured to the back frame 26 and is held at its other end by the post 62 secured to the user support frame 14, as will be described hereinafter. Thus, since the back frame 26 and the handle bars 30, 32 are interconnected by the structure shown in FIG. 2, the resistance band 34 which is connected directly only to the back frame 26 also provides resistance to movement of the handle bars 30, 32.

Figure 3:
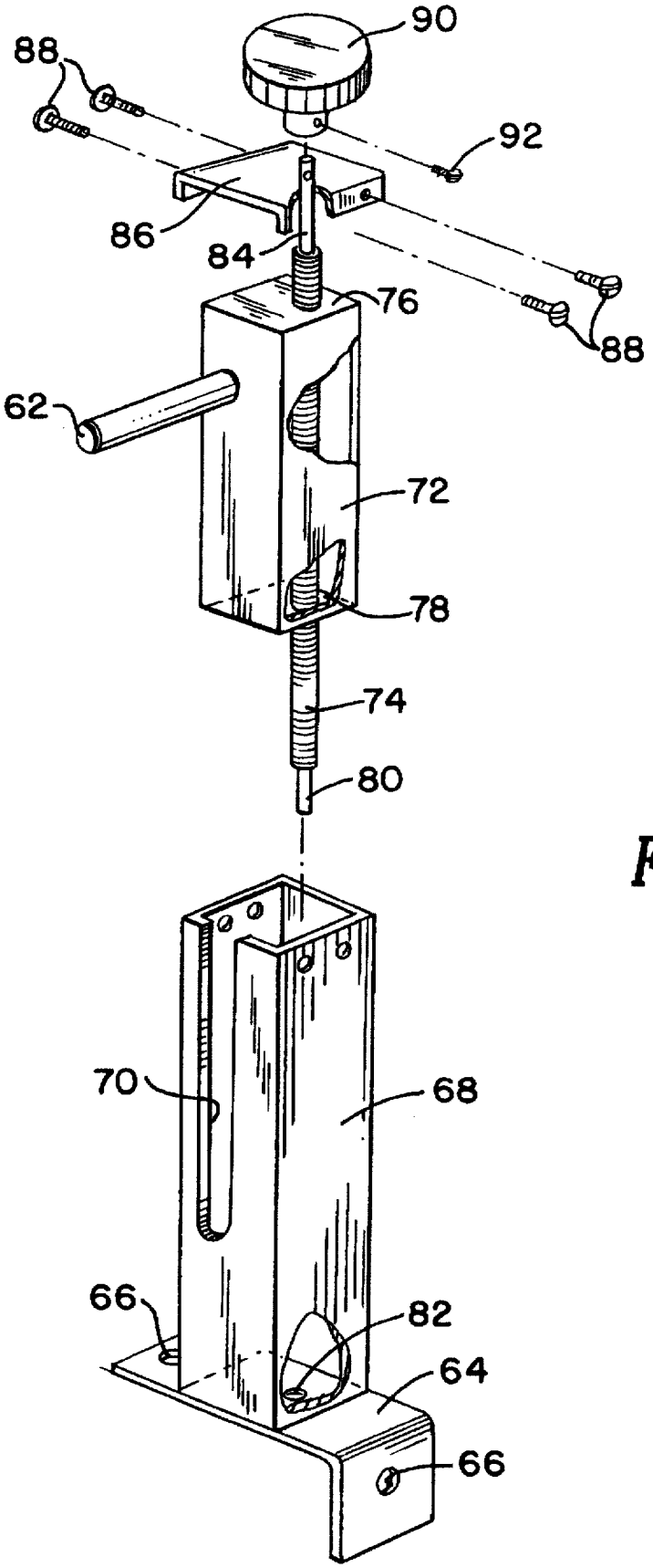
FIG. 3 is an exploded perspective view, partially cut away, showing an inventive mechanism for adjusting the resistance provided by an elastic resistance element.

FIG. 3 illustrates inventive structure for mounting the post 62 to the user support frame 14. This structure, in addition to mounting the post 62, also functions as a mechanism for adjusting the resistance provided by the band 34 so that the user of the apparatus 10 can fine tune this resistance. The structure shown in FIG. 3 includes a lower mounting plate 64 which is generally L-shaped and includes a pair of apertures 66 for securing the plate 64 to the support bar 38 (FIG. 2) by bolts or the like. Secured to the plate 64, as by welding, is an upright hollow tubular member 68. The interior cross section of the tubular member 68 may be non-circular, preferably rectangular or square. An elongated slot 70 is formed in a wall of the tubular member 68 and is open at the top of the tubular member 68. A carriage 72 is supported within the tubular member for vertical movement therein. The exterior cross section of the carriage 72 interferes with the interior cross section of the tubular member 68 so that the carriage 72 is prevented from rotating within the tubular member 68. Preferably, the carriage 72 is rectangular or square. The post 62 is secured to a wall of the carriage 72 and extends through the slot 70 when the carriage 72 is inserted into the tubular member 68. A threaded rod 74 is threaded through aligned apertures in the top and bottom plates 76, 78 of the carriage 72. The bottom end of the rod 74 is unthreaded and is of reduced diameter, as shown at 80, and is journalled for rotation in the aperture 82 of the mounting plate 64, as well as in a suitably positioned aperture in the support bar 38. The upper end 84 of the rod 74 is similarly of reduced diameter and without threads and extends through a suitably positioned aperture in the cover plate 86. After the carriage 72, along with the threaded rod 74, is inserted within the tubular member 68, the top of the tubular member 68 is closed by the cover plate 86, which is secured thereto by screws 88. The upper end 84 of the rod 74 extends through the cover plate 86 and has attached thereto a knob 90, by means of the set screw 92.

The length of the enlarged threaded portion of the rod 74 is equal to the height of the tubular member 68 and the apertures of the mounting plate 64 and the cover plate 86 are only large enough to allow the reduced diameter portions 80, 84 to pass therethrough, so that interference with the mounting plate 64 and the cover plate 86 prevents vertical movement of the rod 74. Rotation of the knob 90 therefore causes the carriage 72 to travel up or down, depending upon the direction of rotation of the knob 90, within the tubular member 68. This adjusts the position of the post 62 to put a desired pre-tension on the elastic resistance band 34, thus fine tuning the resistance provided by the band 34.

Accordingly, there has been disclosed exercise apparatus which includes a pair of movable elements each adapted for user manipulation in a respective direction during a respective one of a pair of independent exercises, which apparatus includes mechanisms for interconnecting a pair of movable elements and for adjusting the resistance applied to the movable element. While an illustrative embodiment of the present invention has been disclosed herein, it is understood that various modifications and adaptations to the disclosed embodiment will be apparent to those of ordinary skill in the art and it is intended that this invention be limited only by the scope of the appended claims. Thus, for example, the resistance adjustment mechanism shown in FIG. 3 could be secured to one of the movable elements, instead of to fixed support structure of the exercise apparatus. Also, while the tubular member 68 and the carriage 72 have been shown as being non-circular, circular elements can also be utilized since the post 62 extending through the slot 70 prevents the carriage 72 from rotating.

What is claimed is:

1. Exercise apparatus including:

a fixed support;

a pair of movable elements each adapted for user manipulation in a respective direction during a respective one of a pair of independent exercises;

an elastic resistance element; and an arrangement for coupling together the fixed support, the pair of movable elements and the resistance element, the arrangement comprising:

a pair of intermeshed circular gears mounted to said fixed support for rotation in opposite angular directions each about a respective one of a pair of parallel axes;

means for securing a first of said movable elements to a first of said gears for rotation therewith;

means for securing the second of said movable elements to the second of said gears for rotation therewith;

first holding means secured to one of said movable elements for holding a first end of said resistance element; and second holding means secured to said fixed support for holding the second end of said resistance element;

wherein one of said first and second holding means includes means for selectively varying the position of the respective end of said resistance element relative to the respective one of said movable elements and said fixed support to provide a desired pre-tension to said elastic resistance element, whereby the amount of resistance provided by said resistance element is adjustable.

2. The apparatus according to claim 1 wherein said one of said first and second holding means includes:

support structure mounted to the respective one of said movable elements and said fixed support;

a carriage mounted to said support structure for movement relative thereto along a defined path;

user operable means for selectively moving said carriage to a desired position along said path; and a holding member secured to said carriage and adapted to hold the respective end of said resistance element.

3. The apparatus according to claim 2 wherein:

said carriage is arranged for linear movement relative to said support structure and is prevented from rotating about the line of movement;

said carriage includes a set of helical internal threads having an axis parallel to said line of movement;

said user operable means includes an externally threaded rod engaging said threads of said carriage; and said user operable means further includes means secured to said rod for rotating said rod about said axis.

4. The apparatus according to claim 3 wherein:

said support structure includes a hollow tubular member having a non-circular interior cross section, a wall of said tubular member being formed with an elongated slot extending parallel to said rod;

said carriage is supported within said tubular member and has an exterior cross section transverse to said rod which interferes with the interior cross section of said tubular member so that said carriage is prevented from rotating about said rod within said tubular member; and said holding member is secured to said carriage and extends out of said tubular member through said slot.

5. An arrangement for providing a selectively adjustable resistance for a user movable element in an exercise apparatus having a fixed support, the arrangement comprising:

an elastic resistance element;

first holding means secured to said movable element for holding a first end of said resistance element; and second holding means secured to said fixed support for holding the second end of said resistance element;

wherein one of said first and second holding means includes adjustment means for selectively varying the position of the respective end of the resistance element relative to the respective one of the movable element and the fixed support to provide a desired pre-tension to said elastic resistance element.

6. The arrangement according to claim 5 wherein the adjustment means includes:

support structure mounted to the respective one of the movable element and the fixed support;

a carriage mounted to said support structure for movement relative thereto along a defined path;

user operable means for selectively moving said carriage to a desired position along said path; and a holding member secured to said carriage and adapted to hold the respective end of said resistance element.

7. The arrangement according to claim 6 wherein:

said carriage is arranged for linear movement relative to said support structure and is prevented from rotating about the line of movement;

said carriage includes a set of helical internal threads having an axis parallel to said line of movement;

said user operable means includes an externally threaded rod engaging said threads of said carriage; and said user operable means further includes means secured to said rod for rotating said rod about said axis.

8. The arrangement according to claim 7 wherein:

said support structure includes a hollow tubular member having a non-circular interior cross section, a wall of said tubular member being formed with an elongated slot extending parallel to said rod;

said carriage is supported within said tubular member and has an exterior cross section transverse to said rod which interferes with the interior cross section of said tubular member so that said carriage is prevented from rotating about said rod; and said holding member is secured to said carriage and extends out of said tubular member through said slot.

9. The arrangement according to claim 5 wherein the exercise apparatus further includes an additional user movable element adapted for user manipulation to perform an exercise independent of the exercise performed by manipulation of the first-mentioned user movable element, the arrangement further including:

a pair of intermeshed circular gears mounted to said fixed support for rotation in opposite angular directions each about a respective one of a pair of parallel axes;

means for securing a first of said user movable elements to a first of said gears for rotation therewith; and means for securing the second of said user movable elements to the second of said gears for rotation therewith.

* * * * *